US008783189B2

(12) United States Patent
Gouault et al.

(10) Patent No.: US 8,783,189 B2
(45) Date of Patent: Jul. 22, 2014

(54) HOIST COMBINATION

(75) Inventors: Jérôme Gouault, La Manceliere (FR); Partick Gaudin, Saint Germains sur Avre (FR)

(73) Assignee: Konecranes Plc, Hyvinkää (FI)

( * ) Notice: Subject to any disclaimer, the term of this patent is extended or adjusted under 35 U.S.C. 154(b) by 505 days.

(21) Appl. No.: 12/999,543

(22) PCT Filed: Jun. 24, 2009

(86) PCT No.: PCT/FI2009/050561
§ 371 (c)(1),
(2), (4) Date: Dec. 16, 2010

(87) PCT Pub. No.: WO2009/156587
PCT Pub. Date: Dec. 30, 2009

(65) Prior Publication Data

US 2011/0089129 A1 Apr. 21, 2011

(30) Foreign Application Priority Data

Jun. 25, 2008 (FI) ..... 20085638

(51) Int. Cl.

| | |
|---|---|
| ***B61B 3/00*** | (2006.01) |
| ***B66C 9/06*** | (2006.01) |
| *B66C 9/02* | (2006.01) |
| *B66C 11/06* | (2006.01) |
| *B61B 13/04* | (2006.01) |

(52) U.S. Cl.
CPC ... *B66C 9/06* (2013.01); *B66C 9/02* (2013.01); *B66C 11/06* (2013.01); *B61B 13/04* (2013.01)
USPC ..... 104/95

(58) Field of Classification Search
CPC ..... E01B 25/08; E01B 25/10; E01B 25/12; E01B 25/22; B61B 13/00; B61B 13/02; B61B 13/04; B61B 13/06; B66C 7/00; B66C 7/02; B66C 7/04; B66C 9/00; B66C 9/02; B66C 9/06; B66C 9/16; B66C 9/18; B66C 11/00; B66C 11/02; B66C 11/04; B66C 11/06
USPC ..... 212/312, 319, 327, 326; 104/89, 90, 91, 104/94, 95, 106, 107, 111; 105/141, 147, 105/148, 150, 154, 155
See application file for complete search history.

(56) References Cited

U.S. PATENT DOCUMENTS

| | | | | |
|---|---|---|---|---|
| 1,858,895 | A | 5/1932 | Juergens | |
| 2,744,472 | A * | 5/1956 | Symons | 105/154 |

(Continued)

FOREIGN PATENT DOCUMENTS

| | | | |
|---|---|---|---|
| DE | 87 15 497.8 | U1 | 3/1988 |
| DE | 90 00 600 | U1 | 3/1990 |
| DE | 10 2004 009 062 | A1 | 9/2005 |
| EP | 0 078 085 | A1 | 5/1983 |
| GB | 1 307 677 | | 2/1973 |

(Continued)

*Primary Examiner* — Sang Kim
*Assistant Examiner* — Nathaniel Adams
(74) *Attorney, Agent, or Firm* — Birch, Stewart, Kolasch & Birch, LLP

(57) ABSTRACT

A hoist combination includes a hoist, a trolley that is arranged to move along a beam provided with side flanges, whereby the trolley includes two trolley flanges arranged on opposite sides of the beam and provided with wheels, by which the trolley moves along the side flanges of the beam; and a securing and adjusting device for securing the hoist to the trolley flanges beneath the beam and for adjusting the mutual distance between the trolley flanges, the securing and adjusting device including supporting slide coupling between the hoist and the trolley flanges and an adjustment bar connected between the trolley flanges, the sliding direction of the adjustment bar and the slide coupling being transverse to the beam.

2 Claims, 1 Drawing Sheet

(56) References Cited

U.S. PATENT DOCUMENTS

Figure 1:
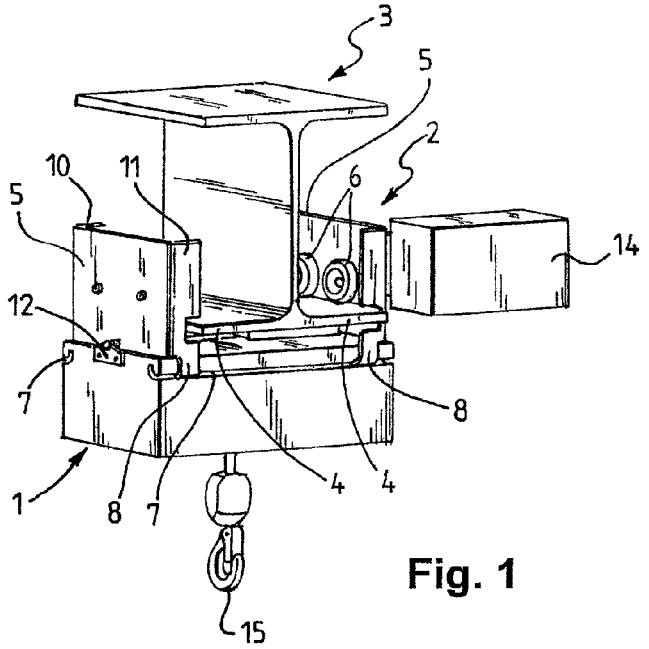

| | | | | |
|---|---|---|---|---|
| 3,017,958 | A * | 1/1962 | Richter | 188/43 |
| 3,261,477 | A | 7/1966 | Powell | |
| 4,343,240 | A * | 8/1982 | Nishimura | 105/54 |
| 6,516,728 | B1 | 2/2003 | Müller et al. | |
| 2006/0226106 | A1 * | 10/2006 | Zaguroli, Jr. | 212/331 |

FOREIGN PATENT DOCUMENTS

| | | | |
|---|---|---|---|
| GB | 2 128 566 | A | 5/1984 |
| GB | 2 158 794 | A | 11/1985 |
| JP | 52-101562 | A | 8/1977 |
| JP | 52-110171 | U | 8/1977 |
| SU | 532563 | A1 | 10/1976 |

* cited by examiner

HOIST COMBINATION

BACKGROUND OF THE INVENTION

The invention relates to a hoist combination comprising a hoist, a trolley that is arranged to move along a beam provided with side flanges, whereby the trolley comprises two trolley flanges arranged on opposite sides of the beam and provided with wheels, by which the trolley moves along the side flanges of the beam; and securing and adjusting means for securing the hoist to the trolley flanges beneath the beam and for adjusting the mutual distance between the trolley flanges.

Previously there are known various hoist combinations running along one overhead girder or hoist beam and hanging downwardly therefrom, these hoist combinations being typically chain hoists. In general, a flanged I-profile serves as the beam. When longer bearing distances or heavier applications are concerned, the beams employed may be box or tube structures with flanges protruding therefrom.

For various applications and various load bearing capacities there are needed beams of different widths and hoist combinations suitable for cooperation therewith. Typically beams of different widths have required a different hoist combination suitable for each particular width. Hence, hoist combinations have employed various, so-called crossheads, which have allowed the hoist combination to be adapted to the application concerned.

There are also known hoist combinations that may be adjusted to run on beams of different widths.

An adjustable hoist combination is known from publication DE 8715497 U, in which the hoist is secured directly with bolts to trolley flanges. In connection with the securing bolts there are washers that may used for adjustment of mutual distance between the flanges.

A corresponding structure with the previous publication is disclosed in publication U.S. Pat. No. 1,858,895 A, which likewise comprises adjustment pieces in connection with the securing screws of the trolley flanges.

From publication U.S. Pat. No. 3,261,477 A there is known direct securing of trolley flanges with pins, which comprise adjustment notches for adjusting the distance between the flanges.

Publication GB 1,307,677 A discloses a solution that is to great extent similar to those in the preceding publications, but in this case, for the securing of the hoist, both the hoist and the securing flanges comprise a plurality of adjacent perforations perpendicularly to the beam provided for the securing bolts to allow selection of different securing points for the flanges.

A problem with known adjustable hoist combinations is a very rough, gradual, yet relatively narrow, adjustment range and the fact that the adjustment is very difficult to carry out because of adjustment components to be screwed loose, in addition to which separate support must be provided for the hoist while adjustments are being made.

SUMMARY OF THE INVENTION

The object of the invention is to eliminate the above-described drawbacks and to provide as simple, accurate and user-friendly securing and adjusting arrangement as possible. This is achieved with the hoist combination of the invention, which is characterized in that the securing and adjusting means comprise supporting slide coupling between the hoist and the trolley flanges and an adjustment bar connected between the trolley flanges, the adjustment bar and the sliding direction of the slide coupling being transverse to the beam.

In a preferred embodiment of the invention the supporting slide coupling comprises grooves provided on the front and rear sides of the hoist and clamps provided in the trolley flanges, extending and gripping in the grooves of the hoist and being in slidable cooperation with the grooves, the adjustment bar being a threaded bar additionally provided with locking means for preventing it from turning in relation to the trolley flanges.

The invention is thus based on mutual gripping of components to be interconnected, in which the gripping points are slidable to locations that are mutually suitable and appropriate using the adjustment bar that interconnects the trolley flanges at the same time.

The arrangement of the invention is extremely simple and its adjustment is very accurate without any steps. The hoist combination is also very compact without extra coupling parts between the hoist and the trolley.

LIST OF DRAWINGS

Figure 3:
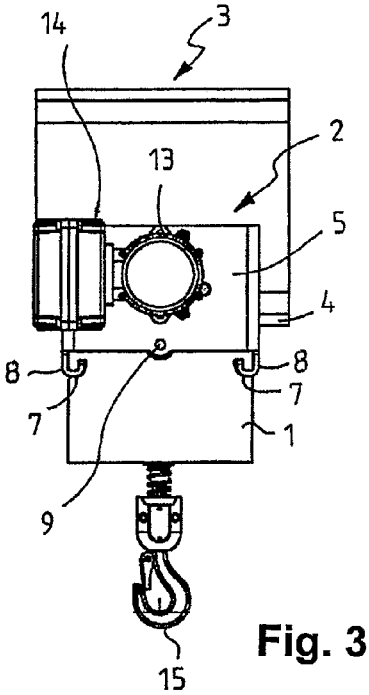
Figure 2:
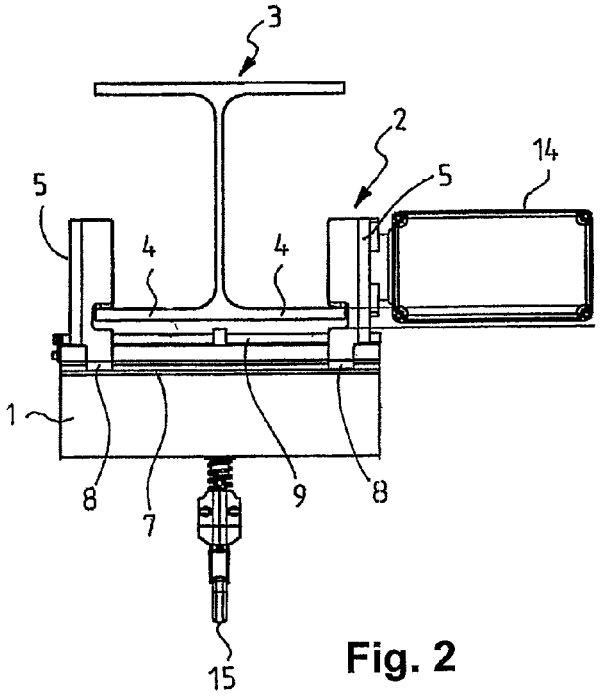

In the following the invention will be described in greater detail by means of a preferred embodiment with reference to the attached drawing, in which FIG. 1 is a perspective view of a hoist combination in accordance with the invention, FIG. 2 is a front view of the hoist combination of FIG. 1; and FIG. 3 is a side view of the hoist combination of the previous figures.

DETAILED DESCRIPTION OF THE INVENTION

With reference to the drawings, an advantageous hoist combination of the invention shown therein comprises a hoist 1 and a trolley 2 as main components.

The trolley 2 is arranged to move along a girder or a beam 3 (I beam) provided with side flanges 4, whereby the trolley 3 comprises two trolley flanges 5 arranged on opposite sides of the beam 3 and provided with wheels 6, which are located on the inner sides of the trolley flanges 5 facing the beam 3 and which support the trolley flanges 5, and thus the whole trolley 2, to move along the side flanges 4 of the beam 3 (the top surface thereof).

The combination of the invention also comprises securing and adjusting means for securing the hoist 1 to the trolley flanges 5 beneath the beam 3 and for adjusting and locking the mutual distance between the trolley flanges 5.

The securing and adjusting means comprise supporting slide coupling 7, 8 between the hoist 1 and the trolley flanges 5 and an adjustment bar 9 connected between the trolley flanges 5, the adjustment bar 9 and the sliding direction of the slide coupling 7, 8 being transverse to the beam 3.

In this preferred embodiment the supporting slide coupling comprises grooves 7 provided on the front and rear sides of the hoist 1 and clamps 8 provided in the trolley flanges 5, extending and gripping in the grooves 7 of the hoist 1 and being in slidable cooperation therewith. The clamps 8, whose total number is four in this case, are provided in the lower edges of the front and rear edges 10, 11 in the trolley flanges 5, whereby said front and rear edges 10 and 11 are bent to be parallel with the front and rear sides of the hoist 1. Thus, the clamps 8 will have sufficient gripping width.

The adjustment bar 9 is a threaded bar at the ends of which there are also provided locking means 12 for preventing it from turning in relation to the trolley flanges 5 and for locking it immovably to the hoist 1. The locking means 12 are arranged at the ends of the hoist 1.

The drawings also show a motor 13 and a control unit 14 on the side of the trolley 2 for driving the trolley 2. The hoist 1 itself and the drive mechanism included therein for lifting and lowering a lifting hook 15 are conventional technology and irrelevant to the invention, and consequently they are not described in greater detain herein.

The above description of the invention is only intended to illustrate the basic idea of the invention. However, a person skilled in the art is able to modify the details thereof within the scope of the attached claims. Thus, said slide coupling may be implemented, for instance, by means of slide bars arranged in the hoist and openings arranged in the trolley flanges, in which the bars are able to move, even though this solution is not expressly shown in the drawings. The front and rear sides of the hoist could also be provided with flanges protruding therefrom.

The invention claimed is:

1. A hoist combination comprising:

a hoist;

a trolley that is arranged to move along a beam provided with side flanges, whereby the trolley comprises two trolley flanges arranged on opposite sides of the beam and provided with wheels, by which the trolley moves along the side flanges of the beam; and securing and adjusting means for securing the hoist to the trolley flanges beneath the beam and for adjusting the mutual distance between the trolley flanges, wherein the securing and adjusting means comprise supporting slide coupling between the hoist and the trolley flanges and an adjustment bar connected between the trolley flanges, the adjustment bar and the sliding direction of the slide coupling being transverse to the beam, and wherein the supporting slide coupling comprises grooves provided on the front and rear sides of the hoist and clamps provided on and projecting beneath the trolley flanges, extending and gripping in the grooves of the hoist and being in slidable cooperation with the grooves.

2. The hoist combination of claim 1, wherein the adjustment bar is a threaded bar additionally provided with locking means for preventing it from turning in relation to the trolley flanges and for locking it immovably to the hoist.

* * * * *